United States Patent [19]

Hergeth

[11] Patent Number: 4,503,798

[45] Date of Patent: Mar. 12, 1985

[54] APPARATUS FOR REMOVING FIBER BALES, IN PARTICULAR PRESSED BALES OF COTTON

[75] Inventor: Hubert Hergeth, Dülmen, Fed. Rep. of Germany

[73] Assignee: Hergeth Hollingsworth GmbH, Fed. Rep. of Germany

[21] Appl. No.: 391,361

[22] Filed: Jun. 23, 1982

[30] Foreign Application Priority Data

Jun. 23, 1981 [DE] Fed. Rep. of Germany ..... 3124635

[51] Int. Cl.[3] ..... D01G 13/00

[52] U.S. Cl. ..... 414/225; 414/749; 414/730; 198/486

[58] Field of Search ..... 414/749–753, 414/730, 222–225; 212/129; 198/486

[56] References Cited

U.S. PATENT DOCUMENTS

| | | | |
|---|---|---|---|
| 2,049,850 | 8/1936 | Lytle | 414/730 X |
| 3,885,825 | 5/1975 | Amberg et al. | 414/753 X |
| 3,986,623 | 10/1976 | Keller | 414/225 |
| 4,005,782 | 2/1977 | Crockett | 414/753 X |
| 4,279,560 | 7/1981 | Ito et al. | 414/753 X |
| 4,336,875 | 6/1982 | Minnetti | 198/486 |

*Primary Examiner*—Leslie J. Paperner
*Assistant Examiner*—Terrance L. Siemens
*Attorney, Agent, or Firm*—Diller, Ramik & Wight

[57] ABSTRACT

Apparatus for removing fiber bales arranged in a row which includes a plurality of spaced generally vertically disposed supports, a pair of spaced generally parallel rails carried by these supports at positions spaced above a surface upon which the fiber bales are arranged in a row, an elongated vertically disposed carriage having upper and lower end portions, the carriage being suspendingly supported by rollers in its vertically disposed position, one of these rollers being driven to move the carriage along the rails, a slide vertically reciprocated upon the carriage, a generally horizontally disposed bracket carried by the slide, the bracket being in overlying relationship to a fiber bale therebeneath, and grabbing fingers carried by the bracket for grabbing fiber from the fiber bale therebeneath.

6 Claims, 8 Drawing Figures

APPARATUS FOR REMOVING FIBER BALES, IN PARTICULAR PRESSED BALES OF COTTON

Figure 1:
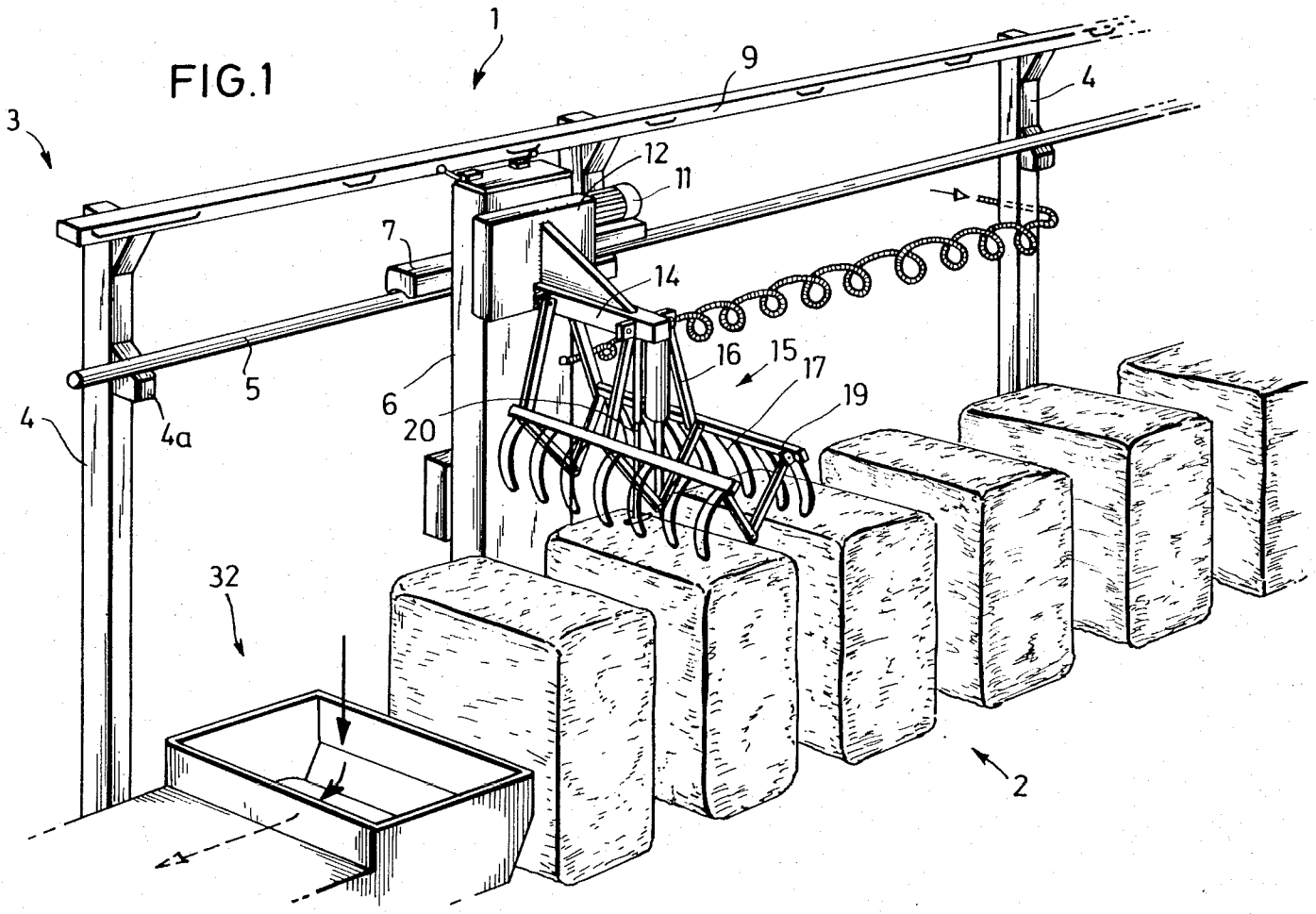

The invention relates to an apparatus for removing fiber bales arranged in a row, in particular pressed bales of cotton, to produce a mix of the fiber material removed from the bales. The apparatus includes a grabbing means displaceable by means of a carriage above and along the row of bales. The grabbing means is movable up and down at the carriage relative to a drop point, and includes a grab head having fingers that can be opened and closed. Devices for opening hard-pressed cotton bales from which the fiber material is removed from the top have been known in different configurations.

In one embodiment, a carriage movable along a row of bales is provided with a column mounted on the carriage and in which one or several grabbing means are conducted by being displaceable in height to project beyond the arranged row of bales which are situated on a support in a high position. Below the row of bales there is a conveyor belt running between the support frames which takes away the fibrous material dropped between the supports to be further processed.

In another embodiment, the grabbing means are arranged at tilting arms coacting in a parallelogram-like manner and pivoted at a carriage movable beside the row of bales. A conveyor belt provided above the row of bales can be tilted to avoid interfering with the grabs. Upon a pick-up of the fibrous material, the conveyor belt is tilted to the horizontal position to receive the fiber material from the grabs. It is the purpose of the tiltable conveyor belt to exclude between the individually arranged fiber bales an interspace for dropping the fiber material. In another embodiment, the conveyor belts which receive the fibers removed from the fiber bales are provided either at the side of the movable carriage or at the other side of the row of bales. A tiltable conveyor belt extends transversely relative to the row of bales for supplying the fibrous material. In place of the conveyor belts, there are provided flaps which can be swivelled out of the reach of the grabbing means, the fiber material being able to drop from the swivelled position to the bottom conveyor belt to be taken away therefrom.

There have been known devices for opening a plurality of pressed bales which are arranged successively in a row and in rows side by side. To this effect, a crane system is used in which a crane truck can be moved on two rails spaced from each other. The crane truck is provided with a trolley movable transversely to the rails and at which the grabbing means and their motion system are mounted. The control of the crank truck, of the trolley and of the grabbing means is achieved by electronic switch elements.

It is the object of the invention to provide an apparatus of the above mentioned type for removing bales arranged in rows, which has a simple and cost-saving construction and in which the control of all moving parts is of a simple, clear design and priced reasonably. The construction of the apparatus of the mentioned type is characterized in that the carriage is suspended at a braced support extending laterally of the row of bales, the grabbing means being provided to permit their upward and downward movement at the suspending carriage by means of a slide designed as a cantilever.

Due to such a design of the apparatus for opening and removing fiber bales arranged in a series, the construction of the frame of the oscillating carriage with grabbing means is very simple. Only a few elements are necessary for the frame, which is narrow and its space requirement is reduced. The hanging arrangement of the carriage entails a ground clearance beneath the travel area. The carriage and its control means are easily accessible. No extensive machine expenditure is required for the equipment which can be produced without any great auxiliary means.

It is advantageous for the suspended carriage to rest by means of a roller or the like on a running rail by being supported laterally at or near the upper end at another rail. Use is made suitably of a tube or an angular profile for the running rail, the roller being provided with a tread surface adapted to the profile thus bringing about a simple and reliable guidance. The other rail can be of an angular or U-shape against the outer leg of which a support roller of the carriage will abut from the inside.

The configuration of the frame together with the arrangement and guidance of the carriage at the frame offer the possibility of realising a frame and rails supporting the carriage in an arc, e.g. along a return bend, the plan view of the plant being U-shaped accordingly. Therefore, the capacity of the plant can be easily increased, by adapting it to the space conditions. The apparatus of the invention for the automatic removal of fiber bales arranged in rows is very advantageous for average capacities.

According to another feature of the invention, the grab head is suspended at a tackle line conducted via an upper stationary guide roller and a lower displaceable guide roller which can be fitted at the piston of a piston-cylinder unit operated by a pressure means. To this effect, one end of the tackle line is connected to a slider under spring action or the like, which can initiate a trip moment for a switch contact. Such a tackle line suspension is not only simple and reliable for the height adjustment of the grab head, but it also includes special advantages for the control of the required lowering depth of the grab head and for its lifting operation.

The object of the invention will be explained hereinafter by means of an embodiment illustrated in the drawing.

Figure 2:
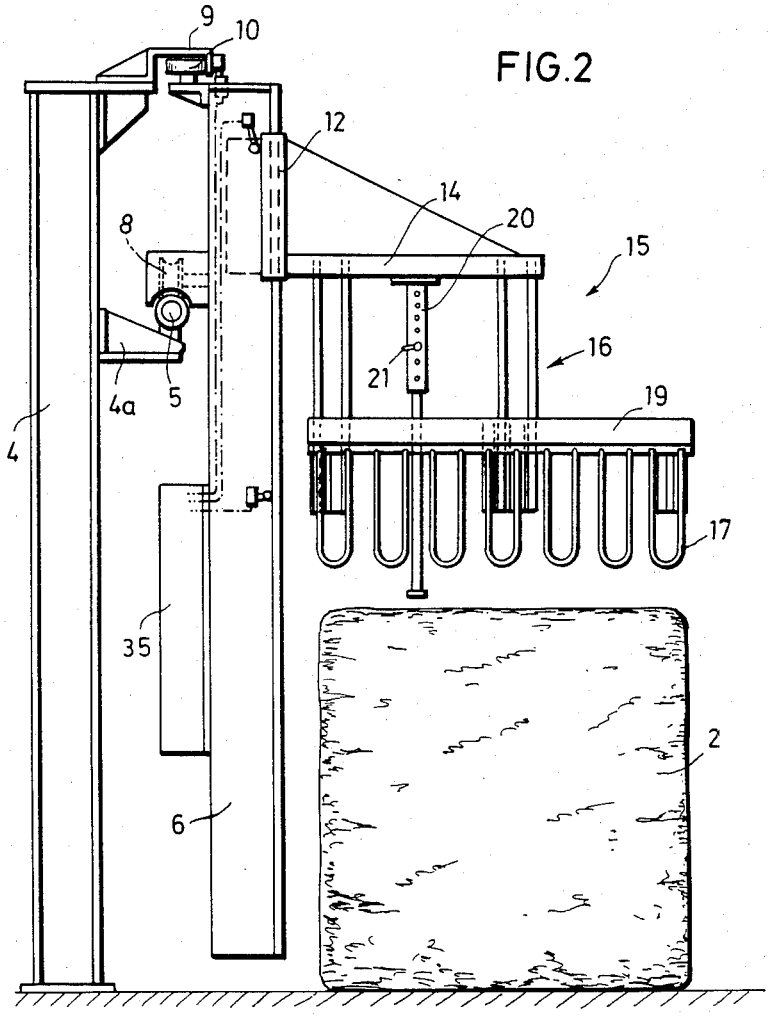
Figure 3:
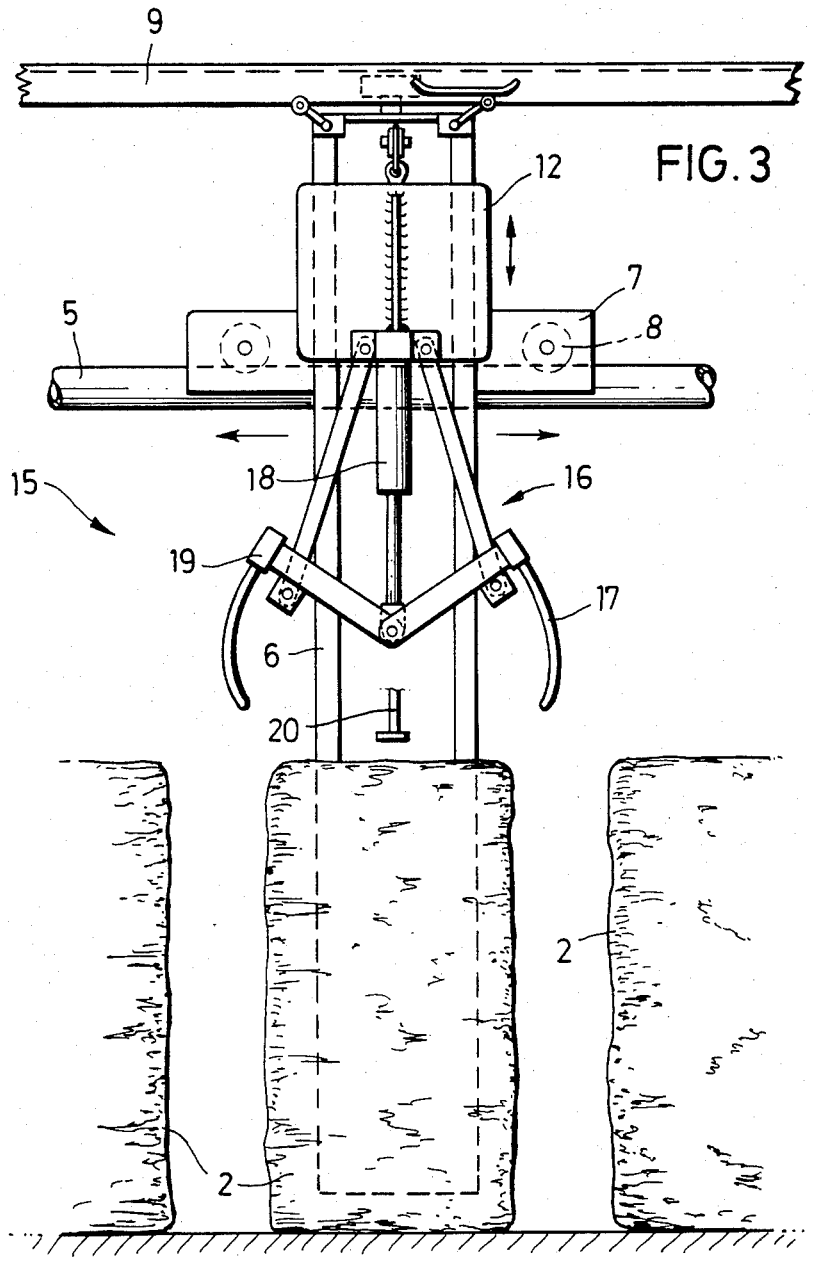
Figure 4:
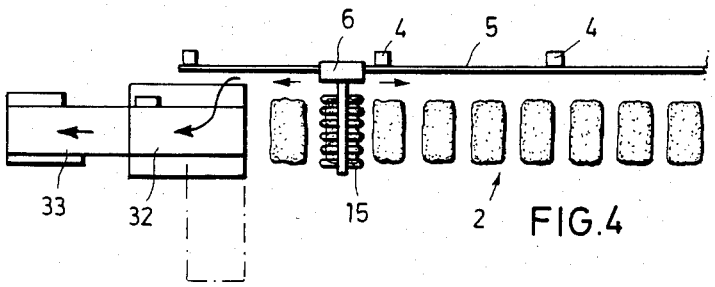
Figure 5:
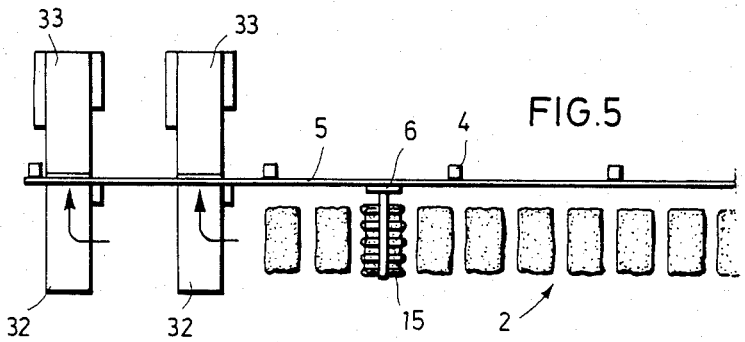
Figure 6:
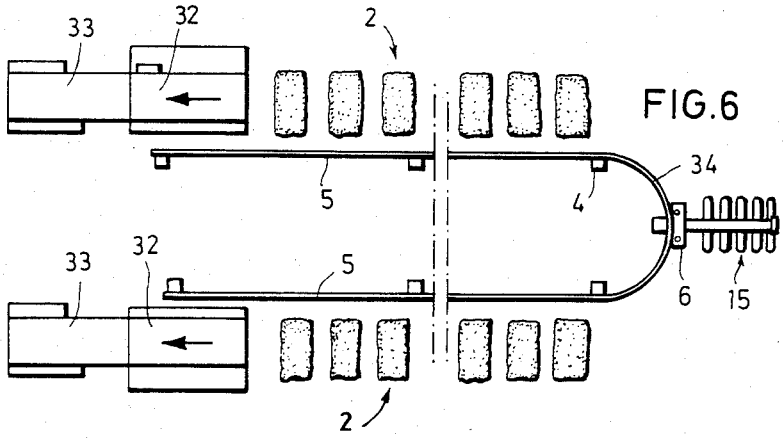
Figures 7, 8:
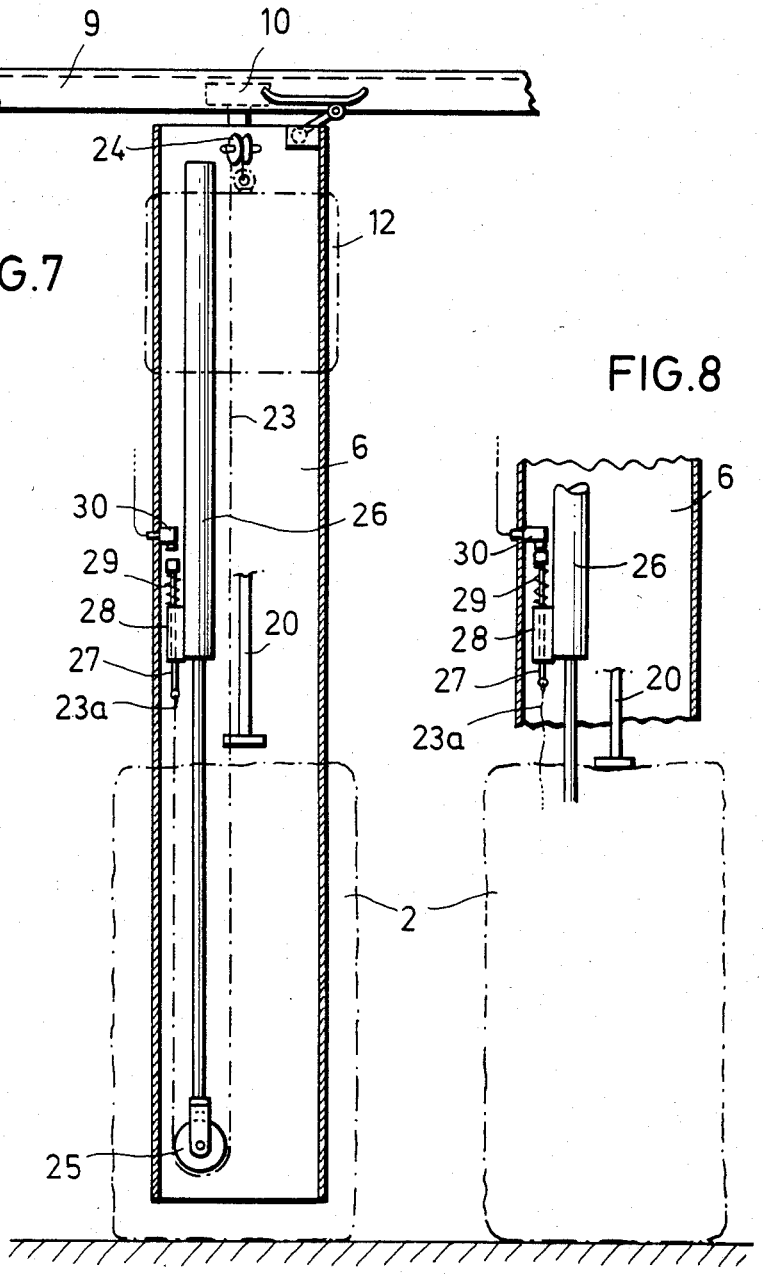

FIG. 1 shows a perspective and schematic view of an embodiment of the apparatus for removing fiber bales arranged in a row according to the invention, FIG. 2 is a schematic end view of the apparatus of FIG. 1, FIG. 3 is a schematic view of the carriage of the apparatus of FIG. 1 with grabbing system, FIGS. 4, 5 and 6 show a schematic plan view to illustrate the different possible arrangements of the plant with respect to the bales put up in a row, and of the drop points, FIGS. 7 and 8 show a schematic view of an embodiment of the design concerning the lifting and lowering movement of the grab head at the suspended carriage by means of a tackle line in different positions.

The device 1 for opening or reducing fiber bales 2 arranged in a row, in particular pressed cotton bales comprises a frame 3 formed by supports 4 and by a rail 5 firmly connected to said supports. On the running rail 5, a carriage 6 is supported by means of an extension 7 comprising rollers 8, the carriage being freely supported in the downward direction. The running rail 5 is preferably formed by a tube resting on brackets 4*a* of the supports 4, the rollers 8 having a tread surface adapted to the tube periphery, thus achieving a perfect guidance.

Another rail 9 provided at or near the upper end of the carriage 6 is borne by the supports 4. Said additional rail 9 serves to laterally support the hanging carriage 6 by means of rollers 10 or the like which abut from the inside against a leg of the angular or U-shaped rail 9. Thus, the carriage 6 is maintained in perpendicular position. A motor 11 driving via a gear one of the running rollers 8 serves as a drive for the carriage 6. Along the carriage 6, there is displaceably fitted a slide 12 being provided with a bracket 14 to mount the grabbing means 15 which comprises rods 16 including grabbing fingers 17. The rods 16 are adjusted by means of a piston-cylinder unit 18 engaging the levers 19 provided with the grabbing fingers 17. The slide 12 with the bracket 14 can be provided with a key head of telescopic design in which the telescopic elements are adjustable relative to each other and can be stopped by means of a locking means 21.

The slide 12,14 with the grab head 15 is adjustable in height by means of a tackle line 23. To this effect, the end of the tackle line 23 secured to the slide 12 is guided via an upper stationary guide roller 24, and via a lower guide roller 25 which is adjustable in height by means of a piston-cylinder unit 26 operated pneumatically. The stationary end 23*a* of the tackle line 23 is connected to a rod 27 or the like supported displaceably in a stationary mounting 27 and being under the action of a compression spring. The displaceable rod 27 may operate as a contact member to initiate the operation of the grab fingers by means of the piston-cylinder unit 18. In FIG. 7, the slide 12 with the grab head 15 is in the uppermost position, while the piston-cylinder unit 26 is moved out as far as possible. As soon as the adjustable key head 12 or the grab fingers 17 of the grabbing means find a resistance due to the bale surface, the downward movement of the slide 12 with the grab head 15 is stopped. The piston-cylinder unit 26 with the lower guide roller 25 moving further backward, the tackle line 23 will slacken. As a result, the compression spring 29 held in compressed position during the lowering of slide 12 and with the stretched tackle line 23 will be released. Therefore, the rod 27 is displaced towards a contact of a valve 30 by which the actuation of the grab fingers is controlled. By the suspension of the slide 12 with the grab head 15, with the aid of a tackle line 23, the lowering movement of the slide 12 with the grab head 15 can be stopped automatically in any optional height of the bale 2, and the grab fingers are actuated by said stop. Thus, a simple and reliable control of the grab head and of the grab fingers is obtained.

At the end of a row of bales, there is a drop point 23 which can be provided as a hopper feeder or as a conveying means 33 to carry away the fiber material mix. The hopper feeder 32 with the conveying means may extend in direction of the row of bales according to FIG. 4 or in transverse direction as shown in FIG. 5, it being possible to provide more than one hopper feeder for one row of bales. It is also feasible to provide frame 1 with running rail 5 with at least one reversing curve 34 thus permitting to locate more than one row of bales. At the end of each row of bales, one hopper feeder each with a conveying means is arranged such as obvious from FIG. 6. At the same time, more than one carriage 6 can be provided at the running rail 5. The removed fiber material is carried away always at the beginning of the corresponding row of bales. The running rail of the frame may be also of a continuous design.

What is claimed is:

1. Apparatus for removing fiber bales arranged in a row comprising a carriage, means for moving said carriage along a predetermined path of travel along which a row of fiber bales are adapted to be disposed, a slide, means for mounting said slide for vertical reciprocal movement relative to said carriage, means for selectively grabbing and releasing fiber bales individually from the associated row of fiber bales, means for supporting said grabbing and releasing means in cantilever relationship relative to said slide, means for sensing the presence of a bale in response to downward movement of said slide, means responsive to said sensing means for operating said grabbing and releasing means, said responsive means includes a fluid motor defined by a cylinder and a piston rod, a tackle line connected to said slide and entrained about said rod, and said tackle line having an end connected to a switch element carried by said piston.

2. The apparatus as defined in claim 1 wherein said switch element is a slider mounted for sliding movement relative to said cylinder, and switch means aligned for operation by said slider.

3. Apparatus for removing fiber from fiber bales arranged in a row comprising a plurality of spaced generally vertically disposed supports, a pair of spaced generally parallel rails carried by said supports at positions appreciably spaced above a surface upon which fiber bales are adapted to be arranged in a row, an elongated vertically disposed carriage having upper and lower end portions, means for suspendingly supporting said carriage in a generally vertically disposed position through said carriage upper portion generally adjacent to and from said pair of rails, said carriage lower end portion being disposed adjacent said surface, means for moving said carriage along said rails, said moving means include at least one roller disposed in driving relationship to one of said rails, means for driving said roller to move said carriage relative to said rails, a slide, means for mounting said slide directly upon said carriage for reciprocal vertical movement relative thereto and to an associated fiber bale therebelow, a generally horizontally disposed bracket carried by and normal to said slide and thereby movable with said slide, said bracket being disposed in overlying relationship to said surface and fiber bales supported thereon, and means suspended from said bracket for grabbing fiber from a fiber bale therebeneath.

4. The apparatus as defined in claim 3 wherein an uppermost of said pair of rails includes a channel housing a roller, and a plurality of other rollers carried by said carriage being supported atop a lowermost of said pair of rails.

5. Apparatus for removing fiber from fiber bales arranged in a row comprising a plurality of spaced generally vertically disposed supports, a pair of spaced generally parallel rails carried by said supports at positions appreciably spaced above a surface upon which fiber bales are adapted to be arranged in a row, an elongated vertically disposed carriage having upper and lower end portions, means for suspendingly supporting said carriage in a generally vertical disposed position through said carriage upper portion and said pair of rails, said carriage lower end portion being disposed adjacent said surface, means for moving said carriage along said rails, said moving means includes at least one roller disposed in driving relationship to one of said rails, means for driving said roller to move said carriage relative to said rails, a slide, means for mounting said slide upon said carriage for reciprocal vertical movement relative thereto and to an associated fiber bale therebelow, a generally horizontally disposed bracket carried by and thereby movable with said slide, said bracket being disposed in overlying relationship to said surface and fiber bales supported thereon, and means suspended from said bracket for grabbing fiber from a fiber bale therebeneath, means for sensing the presence of a bale in response to downward movement of said slide, means responsive to said sensing means for operating said fiber grabbing means, said responsive means including a fluid motor defined by a cylinder and a piston, a tackle line connected to said slide and entrained about said rod, and said tackle line having an end connected to a switch element carried by said piston.

6. The apparatus as defined in claim 5 wherein said switch element is a slider mounted for sliding movement relative to said cylinder, and the switch means aligned for operation of said slider.

* * * * *